US006463970B1

(12) United States Patent
Bradshaw

(10) Patent No.: US 6,463,970 B1
(45) Date of Patent: Oct. 15, 2002

(54) DADO CUTTING SYSTEM FOR A CIRCULAR SAW

(76) Inventor: Thomas M. Bradshaw, 1912 Talkeetna St., Anchorage, AK (US) 99508

( * ) Notice: Subject to any disclaimer, the term of this patent is extended or adjusted under 35 U.S.C. 154(b) by 0 days.

(21) Appl. No.: 09/949,410

(22) Filed: Sep. 5, 2001

(51) Int. Cl.[7] ..... B27G 13/00

(52) U.S. Cl. ..... 144/237; 30/122; 83/698.41; 144/218

(58) Field of Search ..... 30/122, 388; 83/698.41; 144/218, 222, 237, 230; 407/48, 60, 41, 40

(56) References Cited

U.S. PATENT DOCUMENTS 2,751,942 A * 6/1956 Emmons et al. ..... 144/237
2,788,812 A * 4/1957 Jacobs ..... 144/237
4,279,280 A 7/1981 Pairis
5,368,079 A * 11/1994 Benway ..... 144/237

* cited by examiner

*Primary Examiner*—W. Donald Bray
(74) *Attorney, Agent, or Firm*—Michael J. Tavella

(57) ABSTRACT

A saw that uses an extension arbor that fits over the existing arbor to hold a dado blade. The extension arbor is held in place by a locking bolt that passes through a bushed brace that is secured to the guard. In this way, both ends of the extension arbor are supported, providing strength and stability of the saw. The saw has a larger base plate and guard to accommodate the wider blades. Any type of standard dado blade may be used with the extension arbor.

20 Claims, 9 Drawing Sheets

DADO CUTTING SYSTEM FOR A CIRCULAR SAW

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the invention

This invention relates to circular saws and particularly to circular saws that can accept a dado cutting blade 2. Description of the Prior Art Circular saws have been used for many years to cut wood. Typically, these saws are powered, hand-held tools that are used to cut plywood and framing members in construction.

A stationary table saw is typically used in construction and woodworking such as furniture making. A radial arm saw is a circular saw that is mounted on a frame. The saw can be moved on a slide to allow the saw to be pulled through a workpiece. Both the stationary table saw and the radial arm saw cut wood. They also can be used to make special cuts, such as moldings, rabbets and grooves called dados.

Both of these saws have an arbor that extends from the motor. Blades are mounted on this arbor and are held in place with a nut. Most brands of these saws use an arbor that is long enough to accept a dado blade. There are two types of dado blade. The first is called a "wobble" blade. This blade uses a pair of eccentric hubs that are secured around a blade. By adjusting the hubs, the blade can be made to "wobble" when it is placed on the saw arbor. The wobble causes the blade to cut a groove instead of a straight line in a workpiece. The second type of dado blade is a stacked cutter. Here, a number of chipper blades are placed (or stacked) between two outer saw blades. The number of chipper determines the width of the dado. The blades and chippers are all ⅛ inch thick. Using just the two blades produces a dado of ¼ inch. By stacking chipper, the dado with can be extended up to one inch.

Although a hand-held circular saw is very similar to the radial arm saw and is related to the stationary table saw, the hand-held devices cannot make these cuts because they are not designed to accept the large thickness blades needed to make them. Hand-held circular saws have small arbors that typically can accept only one blade. Ostensibly, the use of the small arbor is for safety. These saws are often used by inexperienced users. Placing a dado blade on such a saw improperly could be dangerous. However, these saws are capable of cutting with these blades if the blades could be made to fit on the arbor.

One U.S. Patent teaches a system that attempts to do that. U.S. Pat. No. 4,279,280 to Pairis teaches a system that uses an auxiliary shaft to support a stacked dado cutter. In this design, a bushing is secured to the arbor end of the saw. The arbor is removed. An outer shaft is secured to the bushing by a setscrew. A set of dado blade cutters and spacer washers are placed on the outer shaft. A long locking bolt is placed into the outer shaft to secure the blades in place. The bolt is secured by threads in the bushing. An extra-wide guard is placed over the assembly for safety.

There are several problems with this design. First, the design requires modification of the saw by changing the arbor to the bushing. Next, the outer shaft is secured to the bushing by only a setscrew and the long bolt. Finally, the long bolt is secured in the bushing by only a few threads. While it is possible that the blades will rotate when the saw is turned on, it may not remain stable when cutting actual wood. The length of the long bolt is such that a considerable unsupported moment force may be generated at the head of the long bolt. Moreover, overtime, vibration may cause the setscrew to loosen. Because of the forces on the device when in use, the loose setscrew can cause serious problems in the operation of the device.

BRIEF DESCRIPTION OF THE INVENTION

The instant invention overcomes these difficulties. First, it uses the existing arbor to secure the blades. This eliminates the setscrew and bushing arrangement of the Pairis patent and allows the device to be used with any circular saw. Next, it replaces the saw guard with an extended-width guard. Unlike the guard of Pairis, however, this guard has a bushed bracket that supports the head of the extra-length arbor bolt. Thus, both ends of the bolt are fully supported. This eliminates the unsupported moment on the bolt. Moreover, because no setscrews are used, the effects of vibration are eliminated. With the new system, any type of dado blade can be used with the hand-held circular saw in a safe and efficient manner.

The saw uses an extension arbor, that fits over the existing arbor, to hold a wider dado blade. The extension arbor is held in place by a locking bolt that passes through a bushed brace that is secured to the guard. In this way, both ends of the extension arbor are supported, providing strength and stability of the saw. The saw has a larger base plate and guard to accommodate the wider blades. Any type of standard dado blade may be used with the extension arbor.

DETAILED DESCRIPTION OF THE INVENTION

Figure 1:
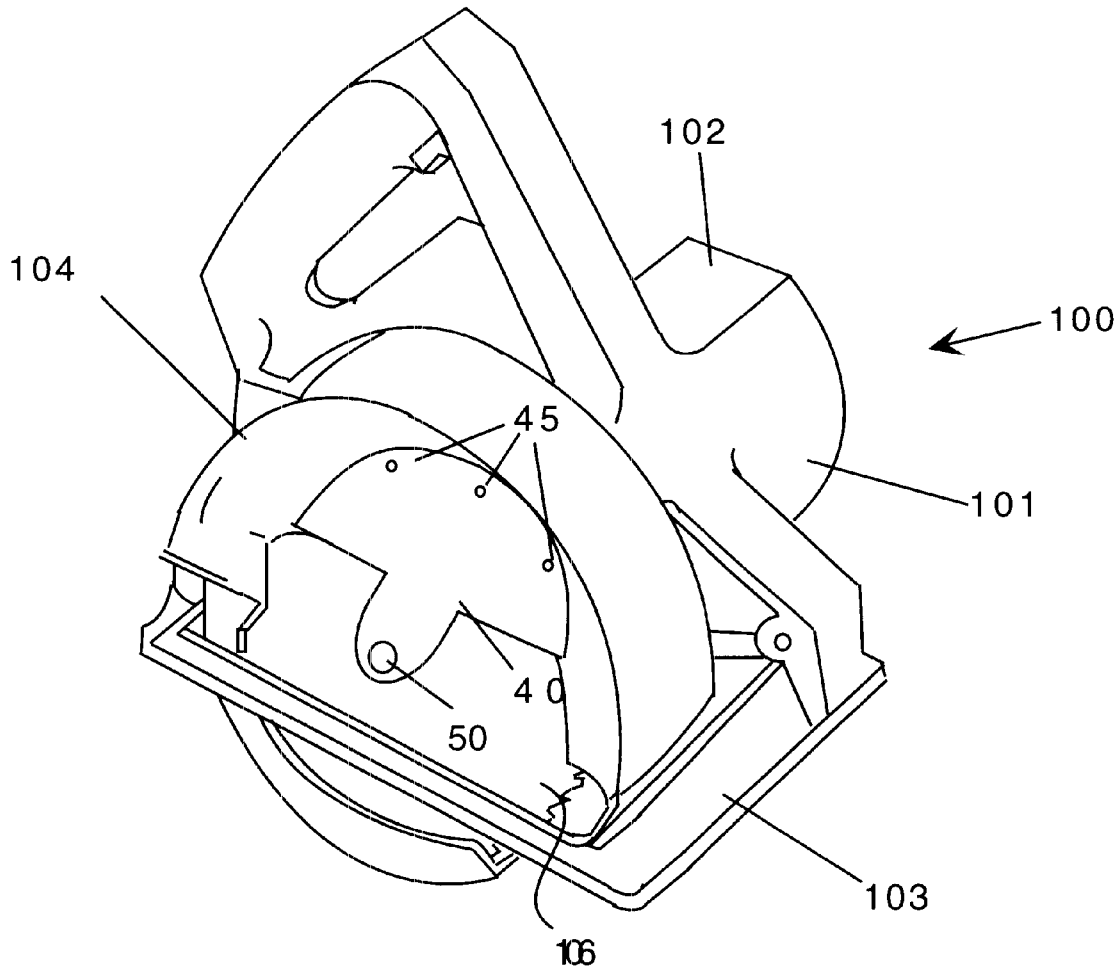
FIG. 1 is a perspective view of the invention as assembled.
Figure 2:
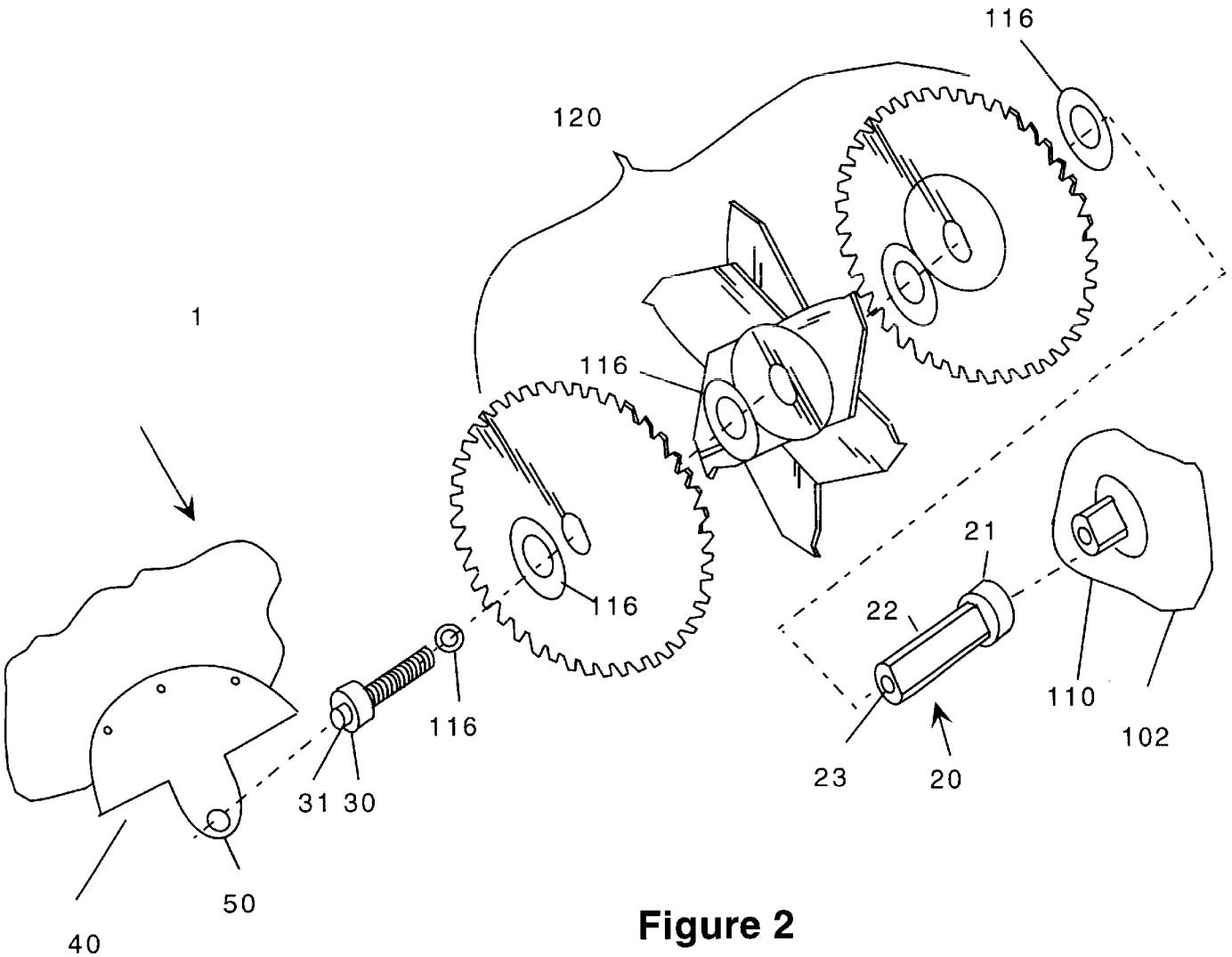
FIG. 2 is an exploded view of the invention.
Figure 3:
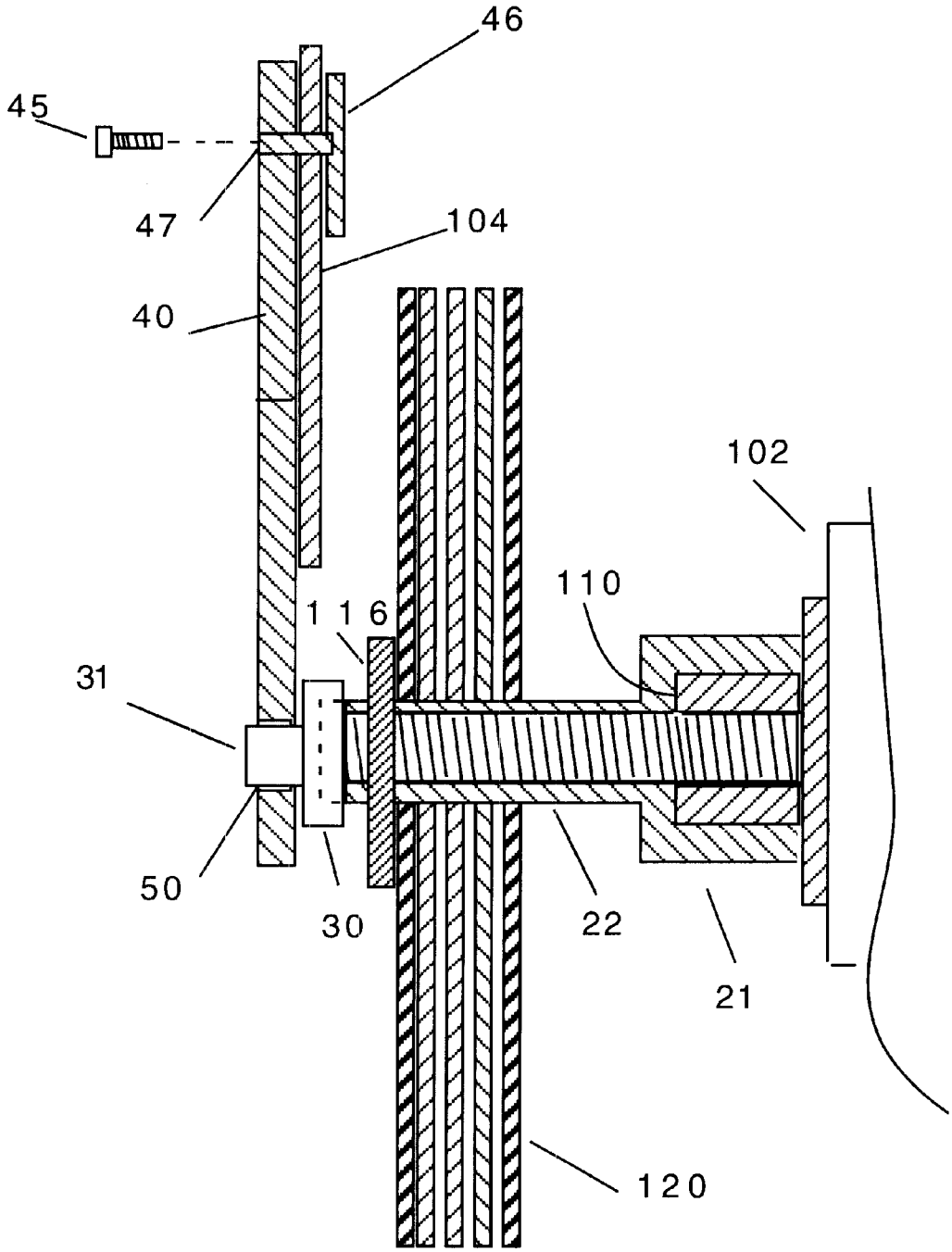
FIG. 3 is a longitudinal section through the locking shaft, groove-cutting saw blade stack and auxiliary components employed therewith as used in the preferred embodiment.
Figure 4:
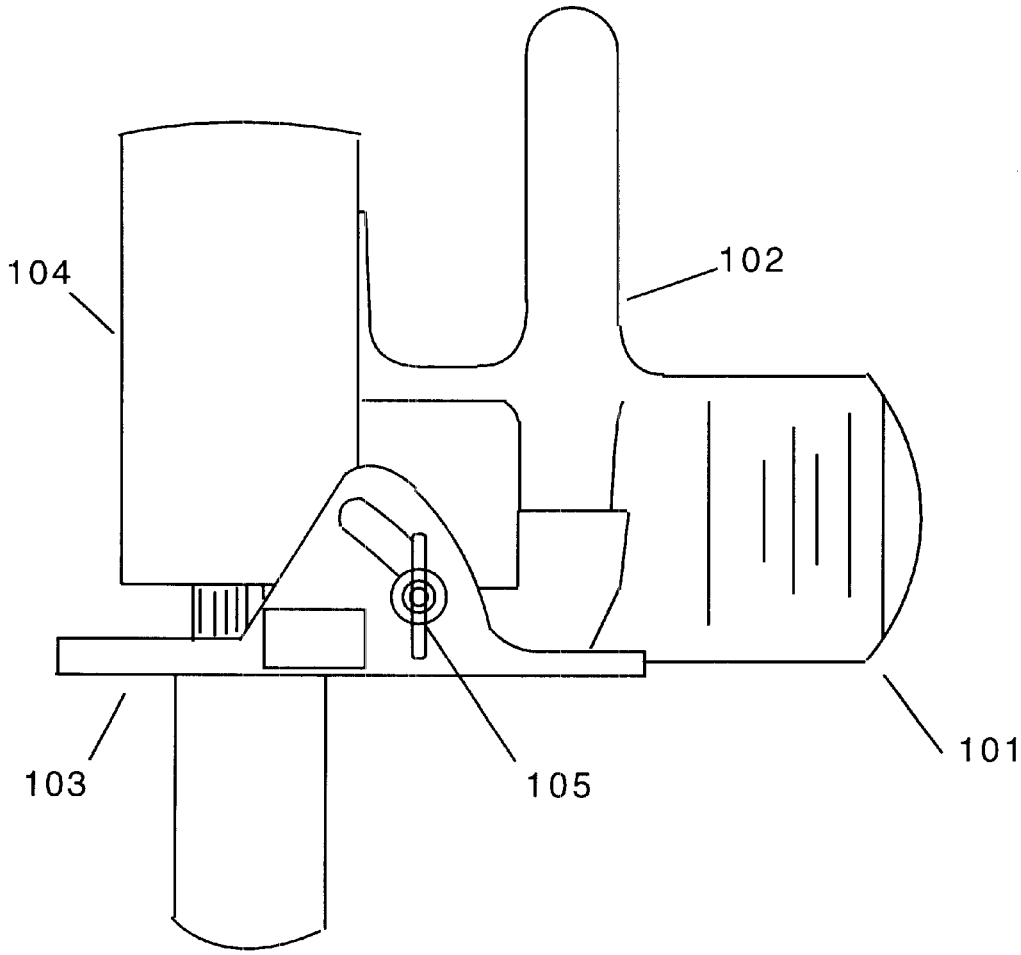
FIG. 4 is a front view of the invention as assembled.

Referring now to FIGS. 1, 2, 3, the dado system 1 is shown. The system is attached to a standard type hand circular saw 100. Typically, these saws have a motor 101, a housing 102, a base plate 103 and a guard 104. As shown in FIG. 4, the base plate 103 is designed to be angled. A thumbscrew 105 is used to hold the base plate at the desired angle for cutting (see FIG. 4). In addition, as shown in FIG.

4, the guard 104 is designed to wrap around the blade 106 for safety. Except for making the base plate and guard larger to accommodate the width of the dado blades, these features of the hand held circular saw are the same as on those available in the marketplace.

In an ordinary hand-held circular saw, the blade is held on an arbor 110 (see FIGS. 2 and 3). The arbor is normally a post that is drilled and tapped to accept a bolt. The arbor may be also "keyed", typically by flattening one or two sides of the post (see, e.g., FIG. 2). The blades typically have a flattened circle formed in them to fit over the arbor. In this way, the blade cannot turn independently of the arbor.

In the instant invention, an extension arbor 20 is used. The extension arbor has a first end 21 that is designed to fit over the arbor 110. This end has a formed post that is drilled in the center and keyed to match the arbor post. When in place, it turns with the arbor, just like a blade. The extension arbor 20 has a shaft 22 that extends outward from the first end. The length of this shaft is sufficient to extend from the top of the arbor to the edge of the guard, as shown in FIG. 3. The end of the shaft 22 forms a second end 23 of the extension arbor. This end 23 is drilled to accept the locking bolt 30, as described below. As shown in FIG. 2, the shaft portion 22 of the extension arbor has the same diameter and shape as the normal arbor. It is longer, however. In this way, the wider dado blades can be installed on the shaft identically to that on a regular arbor.

Next, a dado blade assembly 120 is installed on the extension arbor. Either type of dado blade can be used. Moreover, the blade is either set to a desired width, or the appropriate number of chippers is installed to obtain the desired width. To secure the dado blade on the extension arbor, shims 116 are used. These shims fill any gaps between the base of the extension arbor and the locking bolt 30 that arise because the dado blade is not as wide as the extension arbor shaft. Note that the shims can be spaced on both sides of the blade to enable the blade to be centered on the shaft. The shims can be also spaced on the outer part of the shaft, in which case the dado blade sits up tight against the end of the extension shaft nearest the arbor 110, To support the outer end of extension arbor and dado blade assembly, an outer brace 40 is installed on the outside of the guard. The outer brace 40 is attached to the guard 104 by screws 45. A backing plate 46 (see FIGS. 3, 7 and 8) is installed along the inside edge of the guard. The backing plate 46 has threaded studs 47 that pass through holes 48 drilled in the guard. The outer brace 40 has holes 48*a* (see FIGS. 2 and 9) that align with the studs. Screws or bolts 45 are then used to secure the outer brace 40 to the backing plate 46. The backing plate is used to strengthen the guard and to provide a means for securely screwing the outer brace to the guard.

The outer brace 40 has a bushed opening 50 near the bottom of the brace. The bushed opening 50 is designed to be aligned with the nipple 31 in the top of the locking bolt 30. The bushed opening 50 can have a simple bushing in stalled in it or, in the preferred embodiment, it has a bearing. The locking bolt nipple 31 passes through the bushed opening when the locking nut is installed and then screwed into the extension arbor.

Figure 10:
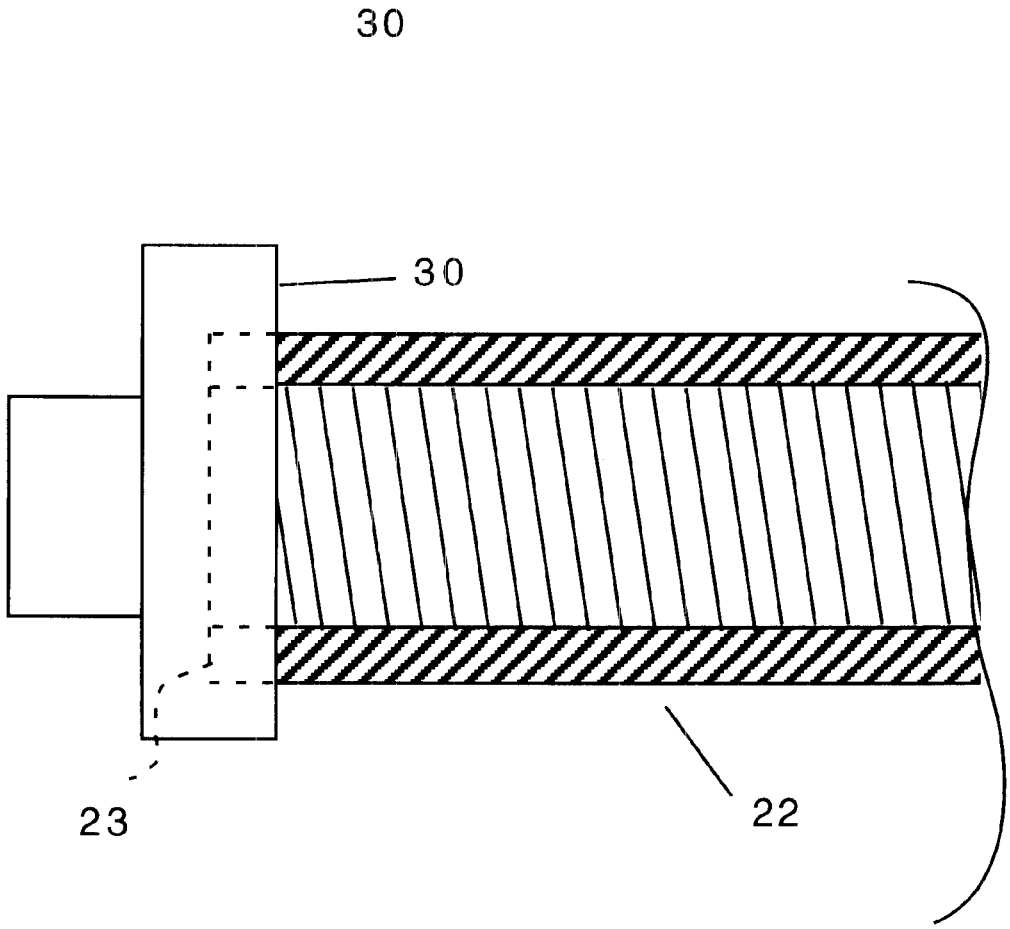
FIG. 10 is a detail view of the locking bolt and extension shaft showing the end of the extension shaft fitting into a recess in the locking bolt head.

Referring now to FIGS. 2 and 3, the saw is assembled for dado cutting as follows. First, the extension arbor is placed on the saw arbor. Next, shims (if desired) can be added. Next, the dado blade or dado blade assembly is placed on the extension arbor. Next additional shims can be placed as needed to fill the remaining length of extension arbor shaft. Next, the locking bolt is placed in the extension arbor shaft. The locking bolt passes through the extension arbor and screws into the saw arbor to lock the assembly in place. As shown in FIGS. 2 and 10, in the preferred embodiment, the head of the locking bolt 30 is recessed to receive the end 23 of the extension shaft 22. Thus, when the locking bolt 30 is fully tightened down, the end 23 of the extension shaft is within the head of the locking bolt. See FIG. 10.

Next, the support bracket is placed on the inside of the guard. The alignment pins pass through the guard when the bracket is in place. Next, the outer brace is fitted such that the nipple at the top of the locking screw fits into the bushed opening and the alignment holes align with the alignment pins. Finally, screws are used to secure the outer brace to the guard and bracket. The saw is then ready for use.

The use of the outer brace gives the main shaft support at its outer extremity. This support ensures that the blades are supported. The extension shaft cannot flex as it might if the shaft was unsupported at its end.

Figure 5:
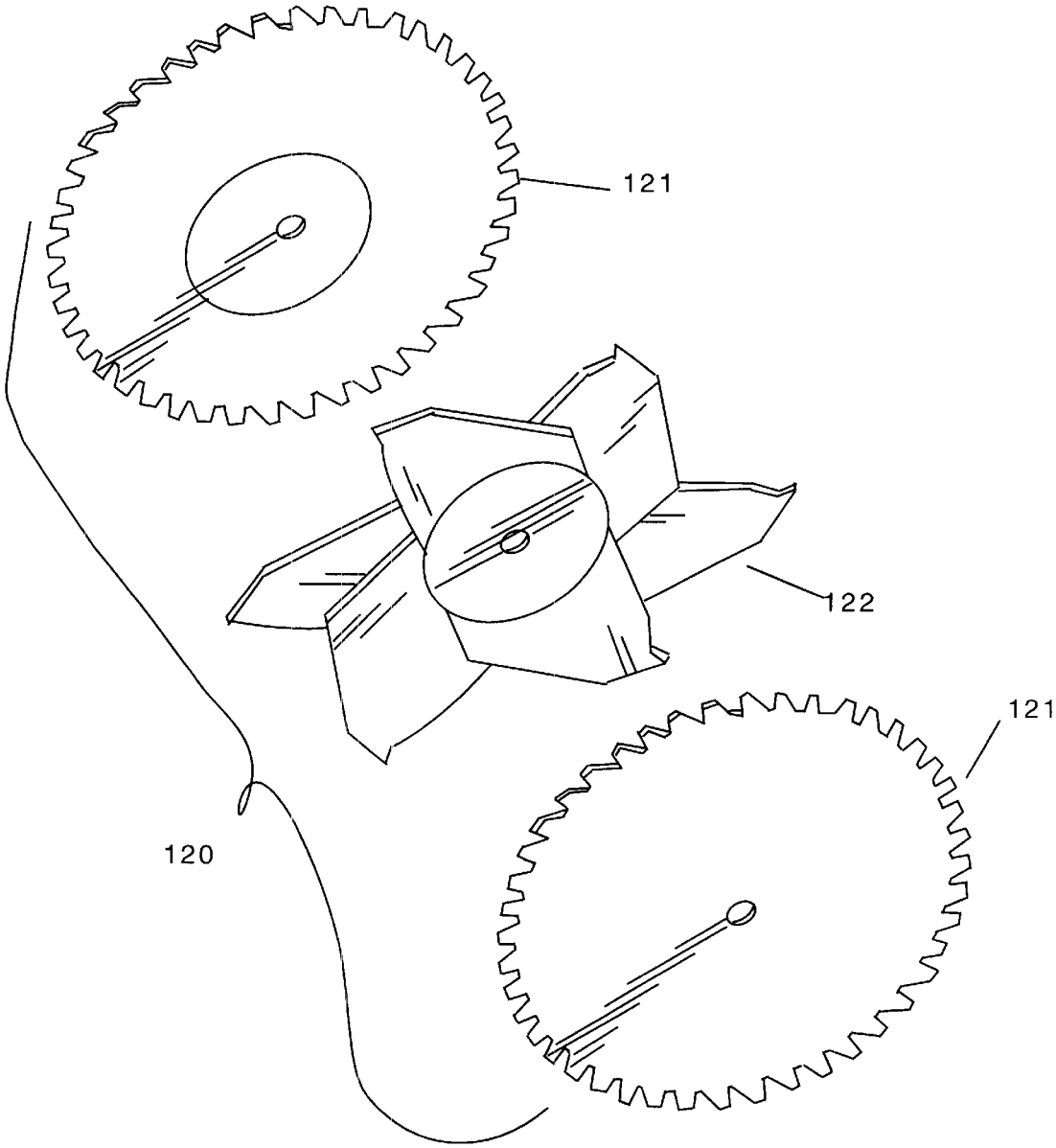
FIG. 5 is an exploded view of a dado blade assembly.
Figure 6:
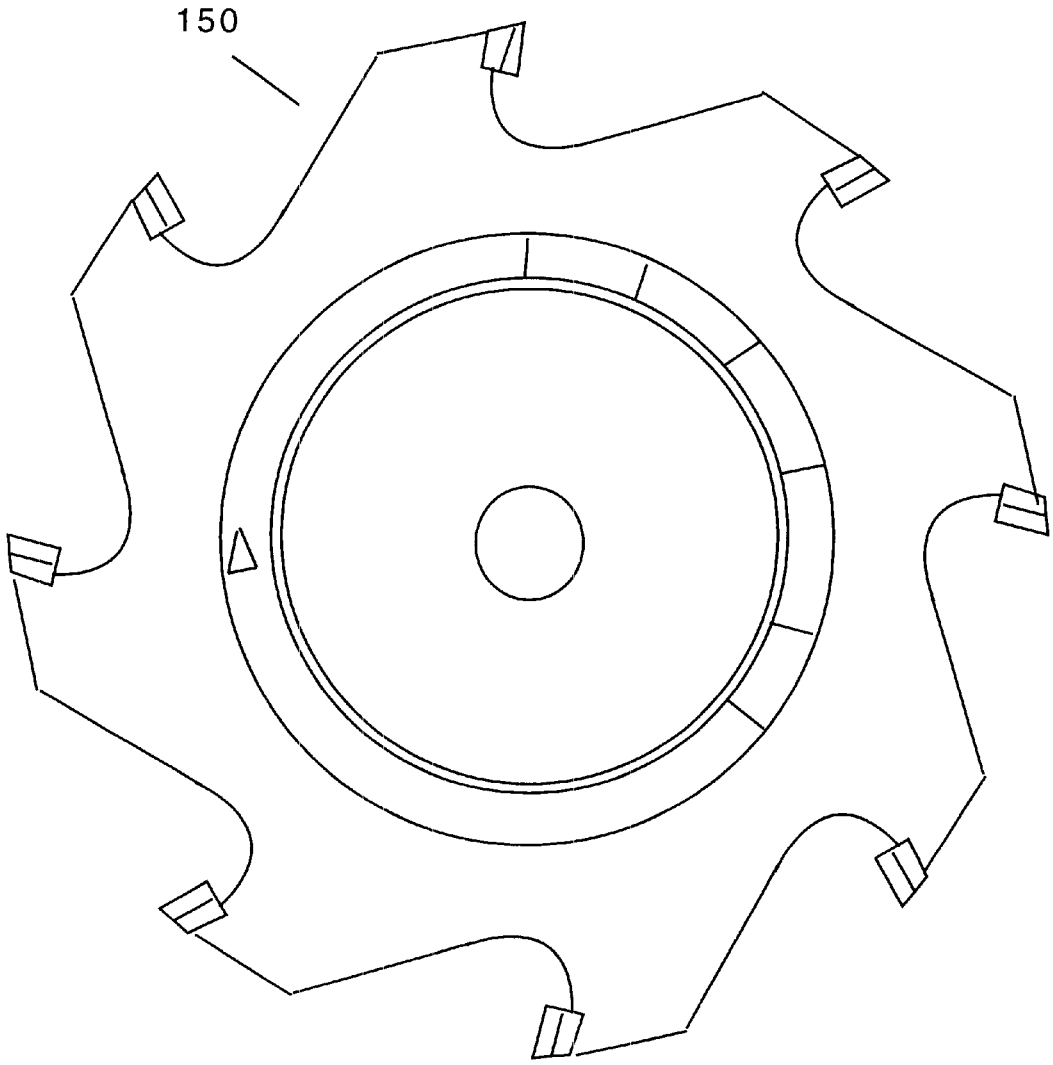
FIG. 6 is a plan view of a wobble type dado blade.

Referring to FIGS. 5 and 6, two different dado assemblies are shown. In FIG. 5, a stacked dado cutter is shown. In this assembly, two outer cutting blades 121 are positioned around a number of chipper blades 122. The width of the dado depends on the number of chippers used. Each of the blades and chippers has a ⅛-inch width. Using two outer blades and two chippers produces a dado of ½ inch. Typically, the width of any stacked dado blade system is limited to 1 inch.

FIG. 6 shows another type of dado assembly 120. This blade is called a "wobble" type blade. It uses eccentric cams to cause the blade to wobble around its center. As the cams are adjusted, the wobble can be set of any desired width up to about one-inch.

Both of these blade systems are well know in the prior art. Examples of the wobble type blade is found in U.S. Pat. Nos. 4,589,458 and 4,018,256. An example of the stacked dado cutter is found in U.S. Pat. No, 5,636,428. The blades are not specific to this invention. Any suitable dado blade can be used with this invention, limited only by the size of the blade.

In addition to dado blades, it is also possible to perform a gag rip operation with the saw. Here, several ordinary cutting blades are installed on the extension arbor. Washers or shims 116 are used to space the blades apart the desired distance. Once the blades are set, the saw is assembled as described above. In use, the saw is used to rip many thin strips from one piece of wood in one cutting operation.

Figure 7:
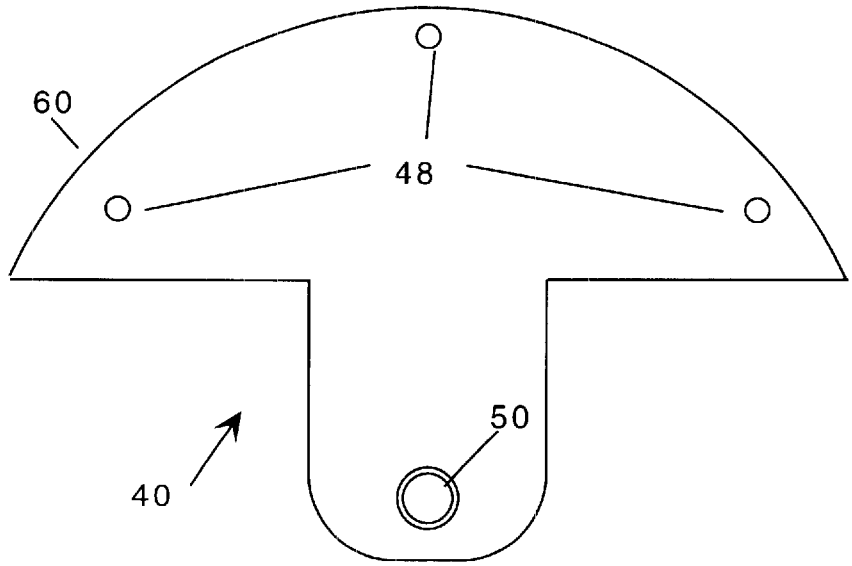
FIG. 7 is a front view of the outer brace.
Figure 8:
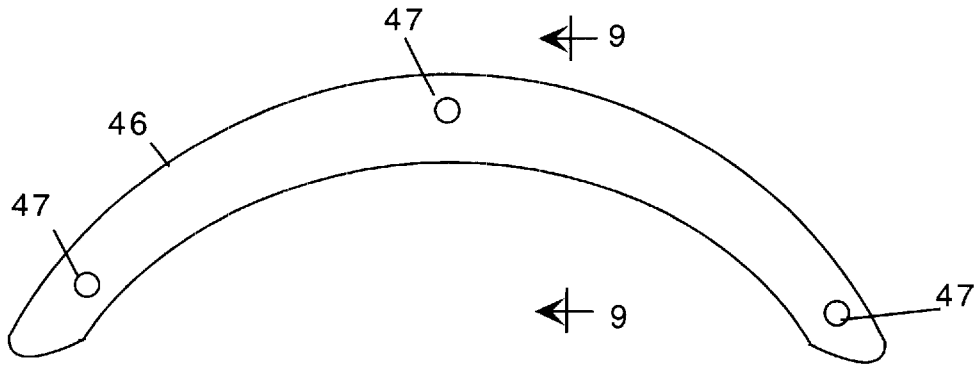
FIG. 8 is a front view of the backing plate.
Figure 9:
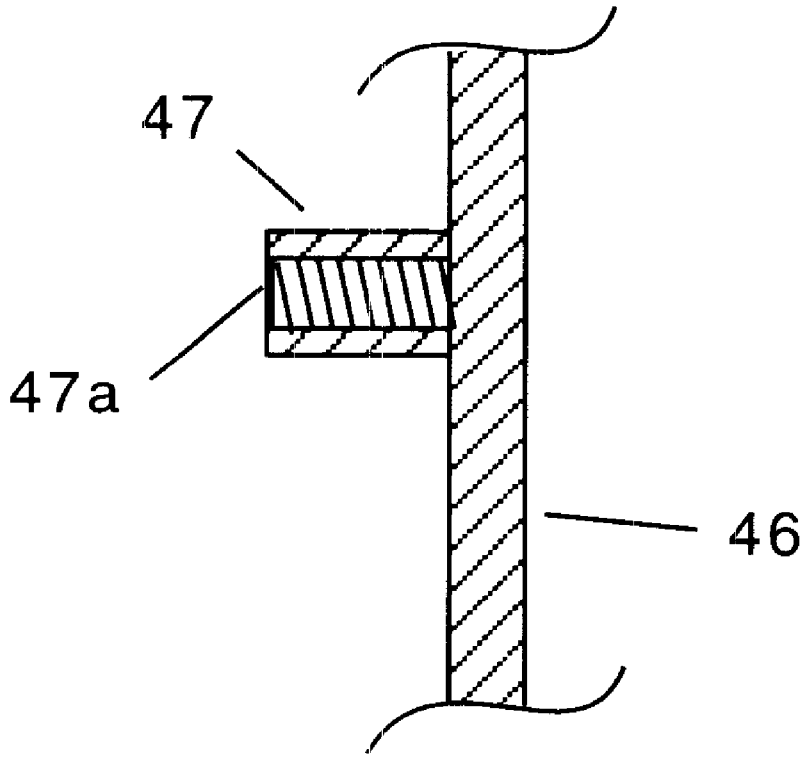
FIG. 9 is a cross-setionional view of the backing plate taken along the lines 9—9 of FIG. 8.

The key to this invention is the use of the outer brace as discussed above. It allows the extended shaft to be extended, giving the user the stability needed for it to work. FIGS. 7, 8 and 9 show details of the outer brace and backer plate. FIG. 7 is a front view of the outer brace 40. As shown, it has a curved upper portion 60 that aligns generally with the shape of the guard. It also has a lower portion 61 that extends down below the guard. This portion has the opening 50 that receives the locking bolt 30. Note that the opening 50 is shown either bushed or with a bearing. The lower portion 61 is designed to extend down so that the bushed opening is aligned with the end of the extension arbor as shown in FIG. 3. FIG. 7 also shows the holes 48*a* that are used to align the outer brace and the backing plate 46.

FIG. 8 is a front view of the backing plate 46. As shown, the backing plate 46 is a curved piece of metal that matches the curve of the guard. The backing plate has three threaded studs 47 that extend forward. These studs pass through the holes in the guard and into the holes 48*a* in the outer brace.

FIG. 9 shows a cross-sectional view of the backing plate 46 showing one of the studs 47 with the threads 47*a* on the inside of the stud.

As discussed above and as shown in FIG. 4, both the base plate 103 and guard 104 of the saw must be widened to accommodate the wider blades. This can be done by simply casting the parts using larger molds. In this way, the basic operation of the saw remains unchanged.

Finally, a saw using this invention can be used to cut with an ordinary blade. In this case, the outer brace is removed, the main shaft and extension shaft are removed. The blade is placed over the arbor and secured with the nut as before.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A removable dado shaft assembly for mounting a dado blade assembly on portable saws having a threaded rotary arbor, and an upper guard, comprising:

a) an extension arbor having a top and a shaft portion with a constant diameter shank, and having a radially extending abutment flange, and a central bore, whereby said abutment flange of said extension arbor is removably installed on said rotary arbor;

b) a locking bolt, having a top, wherein the locking bolt has a nipple extending outward from said top, and further wherein said locking bolt is placed into said central bore, said locking bolt threadably engaging said threaded rotary arbor; and c) an outer brace, attached to said upper guard, said outer brace having an opening therein, whereby said nipple on said top of said locking bolt is secured in said opening in said outer brace.

2. The removable dado shaft assembly of claim 1 wherein the top of said locking bolt has a circular recess formed therein to receive the top of said extension arbor.

3. The removable dado shaft assembly of claim 1 further comprising a backing plate, aligned with said outer brace and secured to said upper guard.

4. The removable dado shaft assembly of claim 3 wherein the blacking plate further comprises a means for attaching said backing plate to said outer guard.

5. The removable dado shaft assembly of claim 4 wherein the means for attaching said backing plate to said outer brace comprise: at least one threaded stud; and a fastener means for threadably engaging said threaded stud.

6. The removable dado shaft assembly of claim 1 further comprising means for securing said dado blade assembly on the extension arbor intermediate the abutment flange and said upper guard.

7. The removable dado shaft assembly of claim 6 wherein the means for securing said dado blade assembly comprises at least one shim.

8. The removable dado shaft assembly of claim 1 wherein the dado blade assembly comprises a stacked type dado blade.

9. The removable dado shaft assembly of claim 1 wherein the dado blade assembly comprises a wobble type dado blade.

10. The removable dado shaft assembly of claim 1 wherein the opening in the outer brace is bushed.

11. The removable dado shaft assembly of claim 1 wherein the opening in the outer brace has a bearing installed within said opening.

12. As an article of commerce, a kit for converting a portable circular saw for grooving operations by mounting a dado blade assembly on a saw shaft, said saw shaft having a threaded rotary arbor, said portable circular saw having an upper guard having an outside and an inside, and also having a plurality of mounting holes therein, said kit comprising:

a) an extension arbor having a top and a shaft portion with a constant diameter shank, and having a radially extending abutment flange, and a central bore, whereby said abutment flange of said extension arbor is removably installed on said rotary arbor;

b) a locking bolt, having a top, wherein the locking bolt has a nipple extending outward from said top, said top having a circular recess formed therein, and further said locking bolt passing through said central bore, and threadably engaging said threaded rotary arbor;

c) an outer brace, positioned on the outside of upper guard, said outer brace having a plurality of mounting holes formed therein and, an opening therein, whereby said nipple on said top of said locking bolt is secured in said opening in said outer brace;

d) an inner bracket, positioned on said inside of said upper guard; and e) a means for attaching said inner bracket to said outer brace.

13. The article of commerce of claim 12 wherein the circular recess formed in the top of said locking bolt receives the top of said extension arbor.

14. The article of commerce of claim 12 wherein the means for attaching said inner bracket to said outer brace comprise: at least one threaded stud, said threaded stud passing through one of said plurality of mounting holes in said upper guard; and a fastener means for threadably engaging the threaded stud through one of said mounting holes in said outer brace.

15. The article of commerce of claim 12 further comprising means for securing said dado blade assembly on the extension arbor intermediate the abutment flange and said upper guard.

16. The article of commerce of claim 15 wherein the means for securing said dado blade assembly comprises at least one shim.

17. The article of commerce of claim 12 wherein the dado blade assembly comprises a stacked type dado blade.

18. The article of commerce of claim 12 wherein the dado blade assembly comprises a wobble type dado blade.

19. The article of commerce of claim 12 wherein the opening in the outer brace is bushed.

20. The article of commerce of claim 12 wherein the opening in the outer brace has a bearing installed within said opening.

* * * * *